US009599946B2

(12) United States Patent
Morinaga et al.

(10) Patent No.: US 9,599,946 B2
(45) Date of Patent: Mar. 21, 2017

(54) IMAGE FORMING APPARATUS

(71) Applicants: Mutsuki Morinaga, Kanagawa (JP); Tadashi Kasai, Kanagawa (JP); Jun Hitosugi, Tokyo (JP); Takamasa Ozeki, Kanagawa (JP); Makoto Yasuda, Kanagawa (JP); Kunio Hasegawa, Kanagawa (JP); Emiko Shiraishi, Tokyo (JP); Wakana Itoh, Kanagawa (JP); Takatsugu Komori, Chiba (JP); Hitoshi Yamamoto, Kanagawa (JP)

(72) Inventors: Mutsuki Morinaga, Kanagawa (JP); Tadashi Kasai, Kanagawa (JP); Jun Hitosugi, Tokyo (JP); Takamasa Ozeki, Kanagawa (JP); Makoto Yasuda, Kanagawa (JP); Kunio Hasegawa, Kanagawa (JP); Emiko Shiraishi, Tokyo (JP); Wakana Itoh, Kanagawa (JP); Takatsugu Komori, Chiba (JP); Hitoshi Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/847,203

(22) Filed: Sep. 8, 2015

(65) Prior Publication Data

US 2016/0070198 A1 Mar. 10, 2016

(30) Foreign Application Priority Data

Sep. 9, 2014 (JP) ..... 2014-182890

(51) Int. Cl.
*G03G 15/08* (2006.01)
*G03G 15/00* (2006.01)

(52) U.S. Cl.
CPC ..... *G03G 15/553* (2013.01); *G03G 15/0824* (2013.01); *G03G 15/0831* (2013.01); *G03G 15/0849* (2013.01); *G03G 15/0853* (2013.01); *G03G 15/0856* (2013.01); *G03G 2215/0888* (2013.01)

(58) Field of Classification Search
CPC ..... G03G 15/0824; G03G 15/0831; G03G 15/0849; G03G 15/0856; G03G 2215/0888
USPC ..... 399/27, 29, 30
See application file for complete search history.

(56) References Cited

U.S. PATENT DOCUMENTS

2007/0116480 A1* 5/2007 Takeuchi ..... G03G 15/5041 399/27
2008/0205923 A1* 8/2008 Takeuchi ..... G03G 15/0853 399/62

(Continued)

FOREIGN PATENT DOCUMENTS

JP 2011-175154 9/2011

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

An image forming apparatus includes a latent image bearer, a developing device, a supplier, and a controller. The controller controls the supplier according to a detection result of a toner density by the toner density sensor and a toner density target value to adjust the toner density of developer in the developing device. The controller is configured to correct the toner density target value and an imaging condition affecting a toner adhesion amount of an output image separately from the toner density, according to a component adhesion deterioration degree being a deterioration degree of carrier due to adhesion of a toner component, obtained based on at least an average image area ratio of the output image, and a coating abrasion deterioration degree being a progression degree of deterioration due to coating abrasion of the (Continued)

carrier, obtained based on at least the average image area ratio of the output image.

11 Claims, 7 Drawing Sheets

(56) References Cited

U.S. PATENT DOCUMENTS

2009/0232526 A1* 9/2009 Yoneda ..... G03G 15/0855 399/30
2010/0080576 A1* 4/2010 Nakayama ..... G03G 15/0848 399/30
2011/0143277 A1* 6/2011 Shiotari ..... G03G 9/0815 430/110.3
2011/0164895 A1* 7/2011 Ishikake ..... B41J 2/01 399/88
2013/0164002 A1* 6/2013 Tanaka ..... G03G 15/0849 399/30
2013/0230332 A1* 9/2013 Ishii ..... G03G 15/556 399/27
2014/0341597 A1 11/2014 Urayama et al.
2014/0348521 A1 11/2014 Mase et al.
2015/0117884 A1 4/2015 Sugiyama et al.
2015/0139668 A1 5/2015 Sugiyama et al.
2015/0160599 A1 6/2015 Kamihara et al.

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2014-182890, filed on Sep. 9, 2014, in the Japan Patent Office, the entire disclosure of which is hereby incorporated by reference herein.

BACKGROUND

Technical Field

Aspects of the present disclosure relate to an image forming apparatus that controls drive of a supplier supplying toner to a developing device to adjust the toner density of developer in a developing device, based on a detection result of the toner density of the developer in the developing device and a toner density target value.

Description of the Related Art

An image forming apparatus to form an image by an electrophotographic process is known that includes a photoconductor, serving as a latent image bearer, to bear an electrostatic latent image and a developing device to develop the latent image on a photoconductor with developer including toner and carrier. Such an image forming apparatus appropriately supplies toner of an amount according to a decrease of a toner density to the developer in the developing device, which has consumed the toner during developing of the latent image. Thus, the image forming apparatus maintains the toner density of the developer in the developing device within a constant range. As carrier particles not consumed by the developing repetitively circulate in the developing device and gradually deteriorate, replacement is regularly conducted.

SUMMARY

In an aspect of the present disclosure, there is provided an image forming apparatus that includes a latent image bearer, a developing device, a supplier, and a controller. The developing device develops a latent image on the latent image bearer using a developer including a toner and a carrier. The toner density sensor detects a toner density of the developer in the developing device. The supplier supplies the toner to the developing device. The controller controls the supplier according to a detection result of the toner density by the toner density sensor and a toner density target value to adjust the toner density of the developer in the developing device. The controller is configured to correct the toner density target value and an imaging condition affecting a toner adhesion amount of an output image separately from the toner density, according to a component adhesion deterioration degree being a deterioration degree of the carrier due to adhesion of a toner component, obtained based on at least an average image area ratio of the output image, and a coating abrasion deterioration degree being a progression degree of deterioration due to coating abrasion of the carrier, obtained based on at least the average image area ratio of the output image.

DETAILED DESCRIPTION

Figure 1:
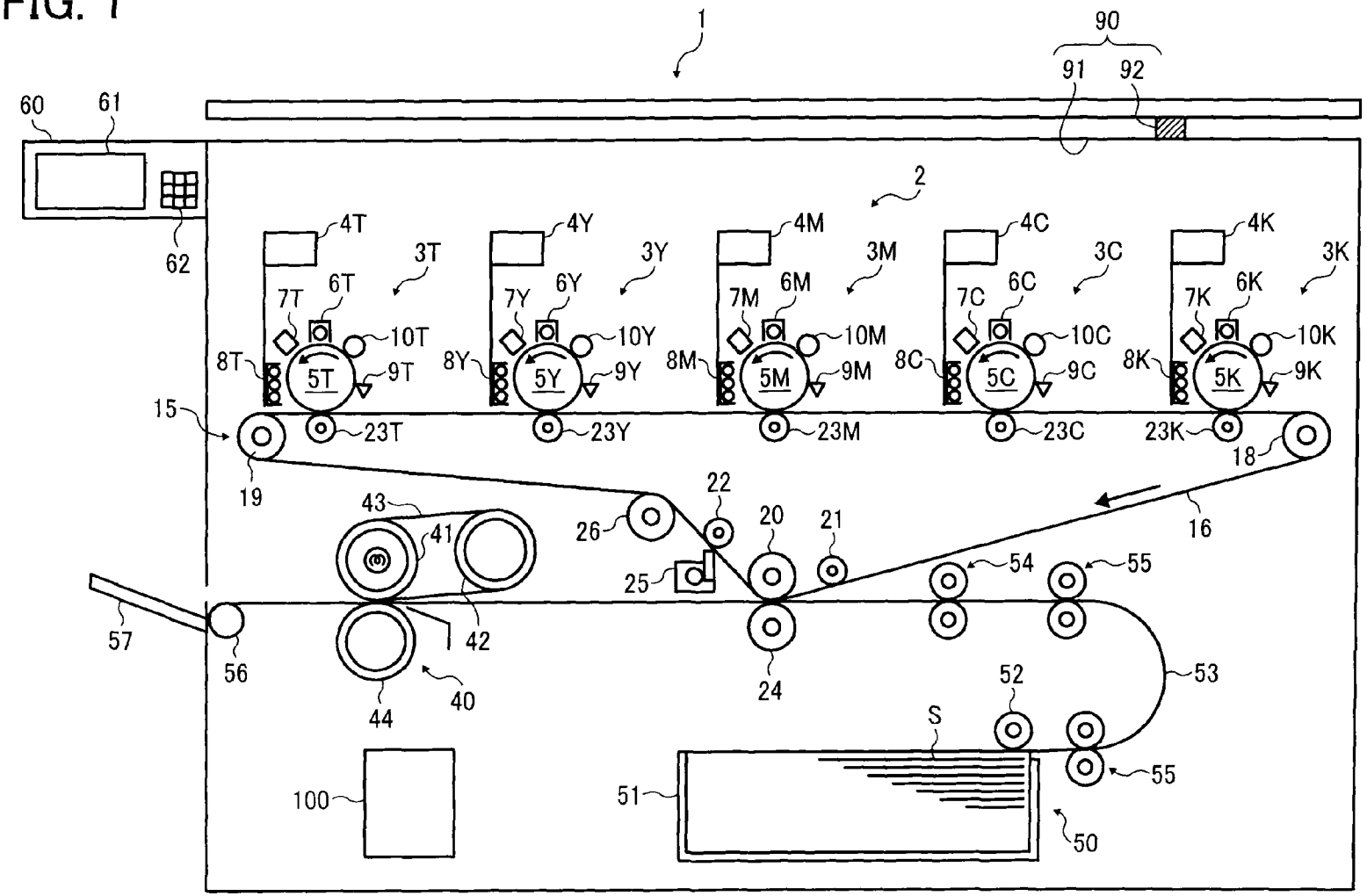
FIG. 1 is a schematic view of an entire configuration of an image forming apparatus according to an embodiment.

As examples of deterioration of carrier, component adhesion deterioration (spent) and coating abrasion deterioration are known. The component adhesion deterioration is the phenomenon in which a component such as an external additive included in toner adheres to surfaces of carrier particles to degrade charging performance of the carrier particles, thereby causing toner scattering from a developing roller driven in a developing device to easily occur. The coating abrasion deterioration is the phenomenon in which electric resistance of the carrier particles is decreased by wearing of surface layers of the carrier particles, thereby causing carrier adhesion to dislocate the carrier particles from the developing roller to a latent image bearer to easily occur. For example, a certain image forming apparatus stores a reference number of printable pages obtained by an experiment as the number of printed pages required to progress at least one of the component adhesion deterioration and the coating abrasion deterioration to the limit, when an image having a predetermined image area ratio is continuously printed. In addition, the image forming apparatus calculates a correction coefficient to correct the reference number of printable pages with a cumulative average image area ratio of an actual output image and calculates a life end number of printed pages, on the basis of a multiplication result of a calculation result and the reference number of printable pages. The image forming apparatus regards a point of time when the life end number of printed pages becomes equal to or larger than the cumulative number of printed pages as a life end point of time of the developer and urges the user to replace the developer.

In such a configuration, it is possible to urge the user to replace the developer before causing toner scattering exceeding an allowable amount by progression of the component adhesion deterioration or causing carrier adhesion exceeding an allowable amount by progression of the coating abrasion deterioration.

However, the inventors have, by experiment, found that timing to urge the user to replace the developer as described above is considerably earlier than appropriate timing according to a balance of the component adhesion deterioration and the coating abrasion deterioration of the carrier. Specifically, in general, as a ratio of an average image area to an output image increases, a cumulative supply amount of a toner component for the developer increases. For this reason, the component adhesion deterioration of the carrier progresses. Meanwhile, as a ratio of the average image area to the output image decreases, the toner supply amount for the developer decreases and friction between carrier particles or between the carrier particles and a stirrer is promoted. For this reason, the coating abrasion deterioration of the carrier progresses. In the image forming apparatus, an image of a ratio of an image area to progress the component adhesion deterioration earlier than the coating abrasion deterioration is continuously printed to calculate the reference number of printable pages. In this case, the number of printed pages at a point of time when a scattered toner amount by the component adhesion deterioration starts to exceed an allowable amount is calculated as the reference number of printable pages. At this point of time, a carrier adhesion amount by the coating abrasion deterioration is still maintained in the allowable range. At this time, when a toner density of the developer is changed to a lower value, toner scattering becomes hard to occur accordingly, but carrier adhesion becomes easy to occur. In addition, both the scattered toner amount and the carrier adhesion amount can be maintained in the allowable range even though the developer is not replaced, according to a decrease range of the toner density or a progression degree of the coating abrasion deterioration of the carrier. In contrast, when the number of printed pages in which the carrier adhesion amount starts to exceed the allowable amount due to the output image area ratio is calculated as the reference number of printable pages, the toner density is changed to a higher value. In this case, both the scattered toner amount and the carrier adhesion amount can be maintained in the allowable range even though the developer is not replaced, according to an increase range of the toner density or a progression degree of the component adhesion deterioration. Therefore, an appropriate value of the reference number of printable pages, that is, appropriate life end timing of the carrier, when the predetermined image area ratio is output, is as follows. Namely, the appropriate value is the number of printed pages (timing) in which the component adhesion deterioration and the coating abrasion deterioration progress in balance in which any one of the toner scattering and the carrier adhesion cannot be maintained in the allowable range, even though the toner density increases or decreases. Nevertheless, in the image forming apparatus, timing when the toner scattering or the carrier adhesion cannot be maintained in the allowable range under a condition of a predetermined toner density is set as the reference number of printable pages and life end timing of the developer is determined. In such a configuration, the timing to urge the user to replace the developer may be earlier than appropriate timing according to the balance of the component adhesion deterioration and the coating abrasion deterioration of the carrier.

According to at least one embodiment of the present disclosure described hereinafter, a replacement time of the developer can be extended to appropriate timing according to the balance of the component adhesion deterioration and the coating abrasion deterioration of the carrier and cost saving can be realized.

Below, an image forming apparatus according to an embodiment of the present disclosure is described. FIG. 1 is a schematic view of an entire configuration of an image forming apparatus 1 according to an embodiment. In this embodiment, the image forming apparatus 1 is described as a printer that forms an image according to an electrophotographic process. However, it is to be noted that the image forming apparatus may be, for example, a printer, a copier, a facsimile machine, a plotter, or a multifunction peripheral of the foregoing capabilities. The image forming apparatus 1 includes a controller 100, a scanner 90, an imaging section 2, a sheet feeder 50, a fixing device 40, an operation display 60, and a transfer unit 15.

Figure 2:
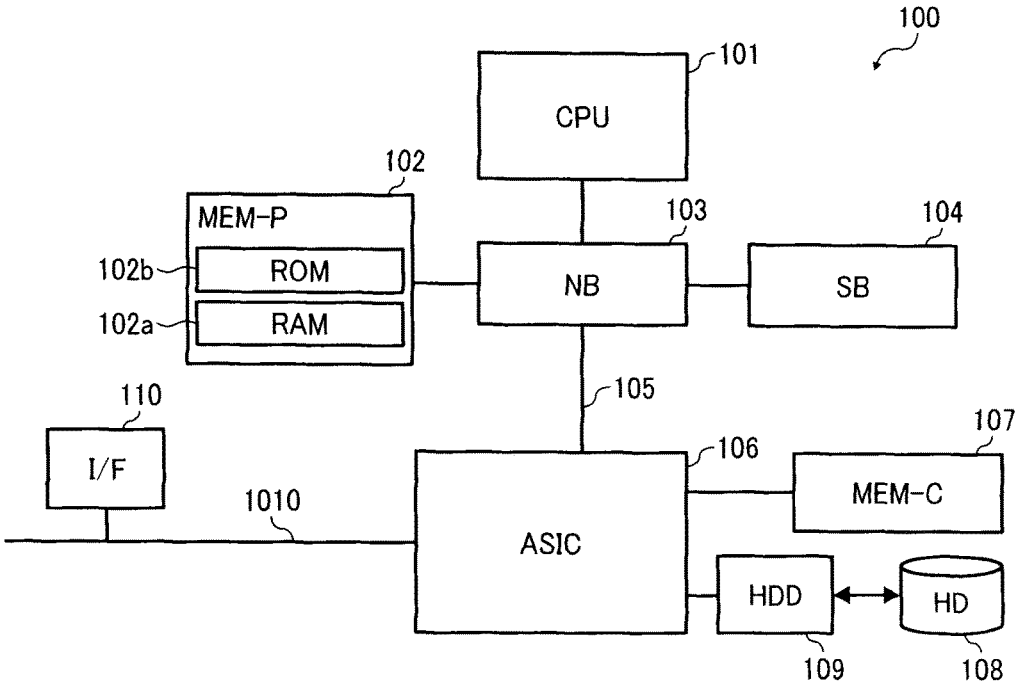
FIG. 2 is a block diagram illustrating an electric circuit of a controller of the image forming apparatus.

As illustrated in FIG. 2, the controller 100 has a central processing unit (CPU) 101, a main memory (MEM-P) 102, a Northbridge (NB) 103, and a Southbridge (SB) 104. The controller 100 further has an accelerated graphics port (AGP) bus 105, an application specific integrated circuit (ASIC) 106, and a local memory (MEM-C) 107. The controller 100 further has a hard disk (HD) 108, a hard disk drive (HDD) 109, and a network I/F 110.

The CPU 101 processes and calculates data or controls operations of the scanner 90, the imaging section 2, the sheet feeder 50, the fixing device 40, and the transfer unit 15, according to a program stored in the MEM-P 102. The MEM-P 102 is a storage region of the controller 100 and has a read only memory (ROM) 102*b* and a random access memory (RAM) 102*a*.

The ROM 102*b* is a storage memory of a program or data to realize each function of the controller 100. The program stored in the ROM 102*b* may be recorded as a file of an installable format or an executable format in a computer readable recording medium such as a compact disk-read only memory (CD-ROM), a floppy disk (FD), a compact disk-recordable (CD-R), and a digital versatile disc (DVD) and may be provided.

The RAM 102*a* functions as a memory for drawing at the time of developing a program or data and memory print. The NB 103 is a bridge to connect the CPU 101 and the MEM-P 102, the SB 104, and the AGP bus 105. The SB 104 is a bridge to connect the NB 103 and a PCI device and a peripheral device. The AGP bus 105 is a bus interface for a graphics accelerator card to speed up a graphic process.

The ASIC 106 includes a PCI target and AGP master, an arbiter (ARB) becoming a core of the ASIC 106, a memory controller controlling the MEM-C 107, and a plurality of direct memory access controllers (DMAC) performing rotation of image data by hardware logic. The ASIC 106 is connected to an interface of a universal serial bus (USB) via a PCI bus 1010. In addition, the ASIC 106 is connected to an interface of IEEE1394 (Institute of Electrical and Electronics Engineers 1394) via the PCI bus 1010.

The MEM-C 107 is a local memory used as an image buffer for copy and a code buffer. The HD 108 is a storage that accumulates image data, accumulates font data used at the time of print, and accumulates forms. The HDD 109 controls reading or writing of data for the HD 108, according to control of the CPU 101. The network I/F 110 exchanges information with an external device such as an information processing apparatus via a communication network.

In FIG. 1, the scanner 90 optically reads an original image by well-known technology and generates image data. Specifically, the scanner 90 exposes light to a sheet, receives reflection light thereof by a reading sensor such as a charge coupled device (CCD) or a contact image sensor (CIS), and reads image data. The image data is information showing an image formed on a recording sheet such as the sheet and is displayed using electrical color separation image signals showing individual colors of red (R), green (G), and blue (B). The scanner 90 has an exposure glass 91 and a reading sensor 92. The sheet from which an image is read is placed on the exposure glass 91. The reading sensor 92 reads image data of the image of the sheet placed on the exposure glass 91.

The imaging section 2 forms an image, on the basis of the image data obtained by reading the original image by the scanner 90 to be an image reader or the image data received by the network I/F 110. The imaging section 2 has five image forming units 3T, 3Y, 3M, 3C, and 3K for transparent (T), yellow (Y), magenta (M), cyan (C), and black (K). The image forming units 3T, 3Y, 3M, 3C, and 3K form toner images using developers including a T toner, a Y toner, an M toner, a C toner, and a K toner, respectively. Hereinafter, the Y toner, the M toner, the C toner, and the K toner are collectively called non-transparent toners. The non-transparent toners are powders made of countless charged resin particles that include a color material such as a pigment and a dye. In contrast, the T toner is a colorless and transparent toner and improves glossiness of a non-transparent toner image, when the T toner adheres to the non-transparent toner image adhering to the recording sheet. In addition, the T toner improves glossiness of a sheet surface, when the T toner adheres to a pure surface of the recording sheet. The T toner is manufactured by externally adding silicon dioxide ($SiO_2$) or titanium dioxide ($TiO_2$) to a low molecular weight polyester resin, for example. Unless the amount of a color material hampers the visibility of a non-transparent toner image, the color material may be included in the T toner.

The five image forming units 3T, 3Y, 3M, 3C, and 3K have the same configuration, except that the toner colors to be used are different from one another. Therefore, an imaging operation will be described hereinafter using the image forming unit 3Y for Y as an example. When any one of the five image forming units 3T, 3Y, 3M, 3C, and 3K is described, one image forming unit is called an image forming unit 3 hereinafter.

The image forming unit 3Y has a toner supplier 4Y, a drum-shaped photoconductor 5Y, a charging device 6Y, an optical writing device 7Y, a developing device 8Y, a diselectrifying lamp 9Y, and a cleaning device 10Y. The toner supplier 4Y supplies a Y premix agent for supply accommodated inside to the developing device 8Y. The Y premix agent is obtained by mixing the Y toner and a magnetic carrier and a density of the magnetic carrier is adjusted to a predetermined value in advance. The Y premix agent accommodated in the toner supplier 4Y is supplied to the developing device 8Y by an amount according to a screw rotation amount, when a transport screw in the toner supplier 4Y is rotation-driven. A toner density sensor 80Y constituted of, e.g., a magnetic permeability sensor is mounted in the developing device 8Y. The toner density sensor 80Y detects a toner density of the developer in the developing device 8Y and transmits a result thereof as a toner density signal to the controller 100. The controller 100 obtains the toner density of the developer in the developing device 8Y, on the basis of the toner density signal, and when a result thereof is lower than a target density, the controller 100 rotates the transport screw in an amount of rotation drive according to a difference of the toner density and the target density. As a result, the Y premix agent is supplied to the developing device 8Y.

Figure 3:
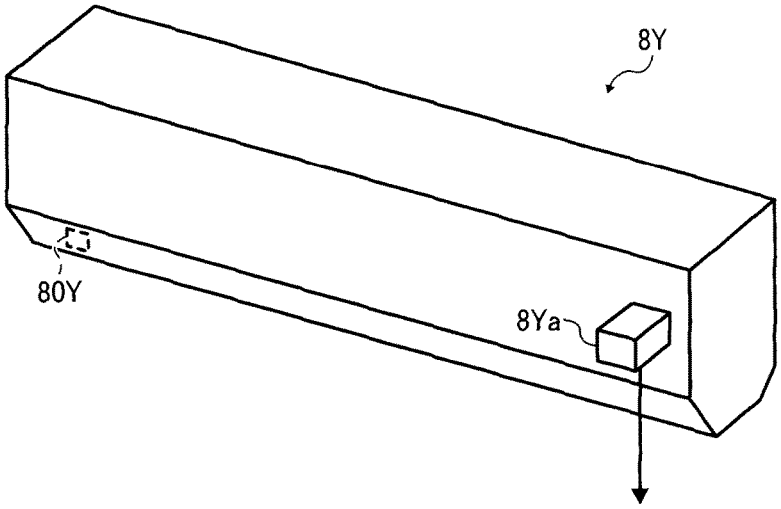
FIG. 3 is a perspective view illustrating a developing device for Y in the image forming apparatus.

FIG. 3 is a perspective view illustrating the developing device 8Y for Y. An overflow duct 8Ya is provided in a casing of the developing device 8Y. When the toner is consumed by developing, a volume of the developer in the developing device 8Y decreases accordingly. When only the Y toner is supplied to the developing device 8Y, the Y toner of an amount almost equal to a decrease amount is supplied. For this reason, the volume of the developer is maintained in a constant range. However, in a configuration in which the Y premix agent is supplied to the developing device 8Y as in the image forming apparatus 1, the magnetic carrier is supplied in addition to the Y toner corresponding to the consumed amount. Thereby when a supply operation is executed, the volume of the developer in the developing device 8Y increases. As a result, when the developer rises, the developer corresponding to a volume increase amount reaches a level of an overflow port and enters the overflow duct 8Ya through the port. In addition, the developer is discharged from the overflow duct 8Ya by gravity dropping as shown by an arrow in FIG. 3. Then, the developer drops in a collecting device and is fed to a collection bottle.

In the image forming apparatus 1, the Y premix agent including the magnetic carrier is supplied to the developing device 8Y, so that the magnetic carrier in the developing device 8Y is replaced little by little. As a result, ease of maintenance can be enhanced by decreasing the replacement frequency due to the life end of the magnetic carrier in the developing device 8Y.

In the photoconductor 3Y rotation-driven in a counterclockwise direction in FIG. 1, a surface is charged uniformly by the charging device 6Y. The optical writing device 7Y is composed of an LED array and optically scans a surface of the photoconductor 5Y, on the basis of image data for Y transmitted from the controller 100. A potential of a portion irradiated with light by optical scanning in an entire region of the surface of the photoconductor 5Y after uniform charging is greatly attenuated. As a result, an electrostatic latent image for Y is formed on the surface of the photoconductor 5Y. The electrostatic latent image is developed by selectively letting the Y toner adhere to the electrostatic latent image by the developing device 8Y accommodating the developer including the Y toner and the magnetic carrier. As a result, a Y toner image is formed on the surface of the photoconductor 5Y. The Y toner image is primarily transferred to a surface of an intermediate transfer belt 16 described below.

The surface of the photoconductor 5Y after the Y toner image is primarily transferred to the intermediate transfer belt 16 is electrified by the diselectrifying lamp 9Y and a post-transfer residual toner is cleaned by the cleaning device 10Y.

The sheet feeder 50 has a sheet feed tray 51, a sheet feed roller 52, a sheet feed path 53, a registration roller pair 54, and a plurality of feed roller pairs 55 and feeds a recording sheet S accommodated in the sheet feed tray 51 to a secondary transfer nip described below. The recording sheet S accommodated in the sheet feed tray 51 is fed to the sheet feed path 53 by rotation drive of the sheet feed roller 52. In the sheet feed path 53, the recording sheet S is fed to a terminal of the sheet feed path 53 while being sequentially nipped by feeding nips by the plurality of feed roller pairs. The recording sheet S hits a registration nip of the registration roller pair 54 disposed in the vicinity of the terminal of the sheet feed path 53, so that a skew is corrected. Then, the registration roller pair 54 is rotation-driven, so that the recording sheet S is fed to a secondary transfer nip by a contact of the intermediate transfer belt 16 and a secondary opposing roller 24.

The image forming unit 3Y for Y has been described. However, similar to the image forming unit 3Y for Y, in the image forming units 3T, 3M, 3C, and 3K for T, M, C, and K, a T toner image, an M toner image, a C toner image, and a K toner image are formed on the surfaces of the photoconductors 5T, 5M, 5C, and 5K. In addition, the toner images are primarily transferred to the surface of the intermediate transfer belt 16.

A transfer unit 15 to endlessly move the endless intermediate transfer belt 16 stretched at a predetermined posture by a plurality of stretching rollers in a clockwise direction in FIG. 1 is disposed among the image forming units 3T, 3Y, 3M, 3C, and 3K and the sheet feeder 50 in a vertical direction. Primary transfer rollers 23T, 23Y, 23M, 23C, and 23K for T, Y, M, C, and K are disposed on the inside of a loop of the intermediate transfer belt 16 and the intermediate transfer belt 16 is nipped between the primary transfer rollers 23T, 23Y, 23M, 23C, and 23K and the photoconductors 5T, 5Y, 5M, 5C, and 5K for T, Y, M, C, and K. As a result, primary transfer nips for T, Y, M, C, and K in which a surface (external surface of the loop) of the intermediate transfer belt 16 and the photoconductors 5T, 5Y, 5M, 5C, and 5K contact one another are formed.

A drive roller 18, a driven roller 19, a secondary transfer roller 20, a secondary-transfer-nip upstream roller 21, and a secondary-transfer-nip downstream roller 22 are disposed on the inside of the loop of the intermediate transfer belt 16. The secondary opposing roller 24 forming the secondary transfer nip, a belt cleaning device 25, and a tension roller 26 to apply tension to the intermediate transfer belt 16 are disposed on the outside of the loop of the intermediate transfer belt 16.

When the drive roller 18 is rotation-driven in the clockwise direction in FIG. 1, the intermediate transfer belt 16 endlessly moves in the counterclockwise direction in FIG. 1. A primary transfer bias is applied to each of the primary transfer rollers 23T, 23Y, 23M, 23C, and 23K for T, Y, M, C, and K by a transfer power supply. As a result, a primary transfer field is formed in the primary transfer nips for T, Y, M, C, and K. By an action of the primary transfer field or a nip pressure, the T toner image, the Y toner image, the M toner image, the C toner image, and the K toner image on the photoconductors 5T, 5Y, 5M, 5C, and 5K are primary transferred to the surface of the intermediate transfer belt 16.

In the course of sequentially passing through the primary transfer nips for T, Y, M, C, and K according to the endless movement, the T toner image, the Y toner image, the M toner image, the C toner image, and the K toner image are superimposed and are primarily transferred to the surface of the intermediate transfer belt 16. A superimposed toner image formed in this way enters the secondary transfer nip by a contact of the surface of the intermediate transfer belt 16 and the secondary opposing roller 24, according to the endless movement of the intermediate transfer belt 16. A secondary transfer bias is applied to the secondary transfer roller 20 nipping the intermediate transfer belt 16 with the secondary opposing roller 24, by a transfer power supply. As a result, a secondary transfer field is formed in the secondary transfer nip.

The registration roller pair 54 feeds the recording sheet S at timing synchronized with the superimposed toner image on the intermediate transfer belt 16 in the secondary transfer nip. By an action of the secondary transfer field or the nip pressure, the superimposed toner image on the intermediate transfer belt 16 is secondarily transferred to the recording sheet S nipped by the secondary transfer nip. As a result, a full-color toner image is formed on a surface of the recording sheet S.

The recording sheet S having passed though the secondary transfer nip is fed to the fixing device 40 described below. In addition, the belt cleaning device 25 removes the post-transfer residual toner from the surface of the intermediate transfer belt 16 after passing through the secondary transfer nip, before the intermediate transfer belt 16 enters the primary transfer nip for T.

The fixing device 40 has a heating roller 41, a stretching roller 42, an endless fixing belt 43, and a pressure roller 44. The fixing belt 43 endlessly moves in the clockwise direction in FIG. 1 by rotation drive of the heating roller 41, in a state in which the fixing belt 43 is stretched by the heating roller 41 and the stretching roller 42 disposed on the inside of the loop. The pressure roller 44 nips the fixing belt with the heating roller 41 and forms a fixing nip. The recording sheet S fed to the fixing device 40 is nipped by the fixing nip and is heated by the heating roller 41 via the fixing belt 43. By an action of the heating or the nip pressure, a full-color toner image is fixed on the surface of the recording sheet S.

The recording sheet S having passed through the fixing device 40 is ejected to the outside of an apparatus via a sheet ejection roller 56 and is stacked on a stack tray 57.

The operation display 60 has a panel display 61 and a key control 62. The panel display 61 includes an image display device and can display a variety of information or images. In addition, the operation display 60 can receive input information from an operator by a touch operation for a screen. The key control 62 includes a plurality of keys such as a numeric keypad and a start key receiving a copy start instruction. The variety of input information received by the operation display 60 is transmitted to the controller 100.

As described above, in FIG. 1, the toner suppliers 4T, 4Y, 4M, 4C, and 4K supply the premix agents for T, Y, M, C, and K to the developing devices 8T, 8Y, 8M, 8C, and 8K, respectively. The premix agents for T, Y, M, C, and K are obtained by mixing the T toner, the Y toner, the M toner, the C toner, and the K toner and the magnetic carrier, respectively. In addition to the toners, the magnetic carrier is supplied, so that the magnetic carrier is replaced. Therefore, a replacement cycle of the magnetic carrier in the developing devices 8T, 8Y, 8M, 8C, and 8K can be extended and ease of maintenance can be enhanced. However, because the carrier density of the premix agent is not high to prevent the magnetic carrier from being deteriorated, the replacement cycle is relatively long, but it is necessary to replace the magnetic carrier regularly.

As the deterioration of the magnetic carrier, the component adhesion deterioration and the coating abrasion deterioration are known. The following table 1 shows a relation among a deterioration type, a carrier characteristic change, and an occurring failure.

TABLE 1

| Deterioration Type of Carrier | Change of Carrier Characteristic | Failure |
|---|---|---|
| Component adhesion deterioration | Reduction in charging performance | Toner scattering |
| Coating abrasion deterioration | Decrease of Resistance | Carrier adhesion |

The component adhesion deterioration is the phenomenon in which external additives (Si, Ti, and the like) added to toner powders, wax, and toner particles adhere to carrier particle surfaces of the magnetic carrier to degrade charging performance of the magnetic carrier. If the component adhesion deterioration of the magnetic carrier progresses, the magnetic carrier particles are not charged surely and the toner particles are not charged surely, thereby causing toner scattering to occur or causing transfer to be deteriorated remarkably.

In addition, the coating abrasion deterioration is the phenomenon in which a surface layer of the carrier particles of the magnetic carrier is shaved by wearing. If the coating abrasion deterioration of the carrier particles progresses, electric resistance of the carrier particles decreases to cause the phenomenon called carrier adhesion to dislocate the carrier particles to the surface of the photoconductor.

Figure 4:
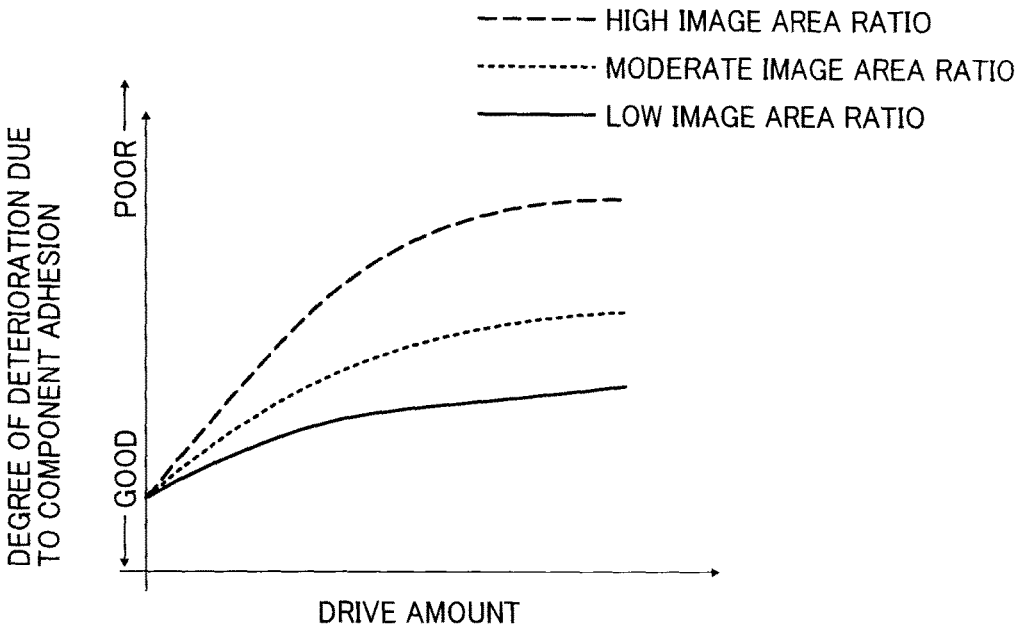
FIG. 4 is a graph illustrating a relation between progression degree of component adhesion deterioration obtained by an experiment carried out by the inventors and drive number.

Next, a characteristic configuration of the image forming apparatus 1 according to the embodiment will be described. FIG. 4 is a graph illustrating a relation between progression degree of the component adhesion deterioration (spent) obtained by an experiment carried out by the inventors and drive number. In the experiment from which the graph of FIG. 4 is obtained, different from the image forming apparatus according to the embodiment, a tester for image forming apparatus to supply only the toner to the developing device is used. The drive number is a parameter in which a cumulative drive amount of the developing device is reflected and a surface travel distance of a developing sleeve bearing the developer and rotating in the developing device, a drive time of the developing device, and a cumulative number of printed pages can be exemplified as the parameter. In FIG. 4, the relation with the progression degree of the component adhesion deterioration is graphed using the surface travel distance of the developing sleeve as the drive number. However, the same relation is obtained even though the drive time is used.

As illustrated in FIG. 4, a positive correlation is realized in the progression degree of the component adhesion deterioration and the drive number. In addition, a positive correlation is realized in an average image area ratio and the progression degree of the component adhesion deterioration and the component adhesion deterioration progresses quickly when the average image area ratio increases.

As such, the progression degree of the component adhesion deterioration is calculated by a multivariable function based on the average image area ratio to be a variable and the drive number to be a variable. As in the image forming apparatus according to the embodiment, it has been determined by the experiment carried out by the inventors that the progression degree of the component adhesion deterioration can be accurately predicted by the multivariable function based on the average image area ratio and the drive number, in the configuration in which the premix agent is supplied to the developing device. Therefore, the controller 100 of the image forming apparatus 1 according to the embodiment calculates a first index value showing the component adhesion deterioration degree by the following first expression.

First index value=*f*(average image area ratio,drive number) first expression

Next, the controller 100 corrects the first index value calculated using the first expression, on the basis of a carrier supply amount by supplying of the premix agent. Specifically, the first index value is corrected by the following correction expression functioning as the multivariable function.

First index value=*f*(solution of first expression,carrier supply amount) correction expression In addition, the controller 100 calculates the carrier supply amount in a correction algorithm, on the basis of the following expression functioning as the multivariable function.

Carrier supply amount=*f*(average image area ratio, drive number)

In the expression, the reason why the carrier supply amount is calculated using the average image area ratio and the drive number as the variables is as follows. That is, when the drive number increases, more images are output. For this reason, more premix agents are supplied to the developing device. In the drive number, if the average image area ratio increases, more premix agents are supplied to the developing device. Therefore, an algorithm showing a positive correlation of the average image area ratio and the drive number and the carrier supply amount is realized. Because the carrier supply amount can be calculated by the following expression, the following expression may be used, instead of the previous expression.

Carrier supply amount=*f*(average image area ratio, target toner adhesion amount of output image)

Figure 5:
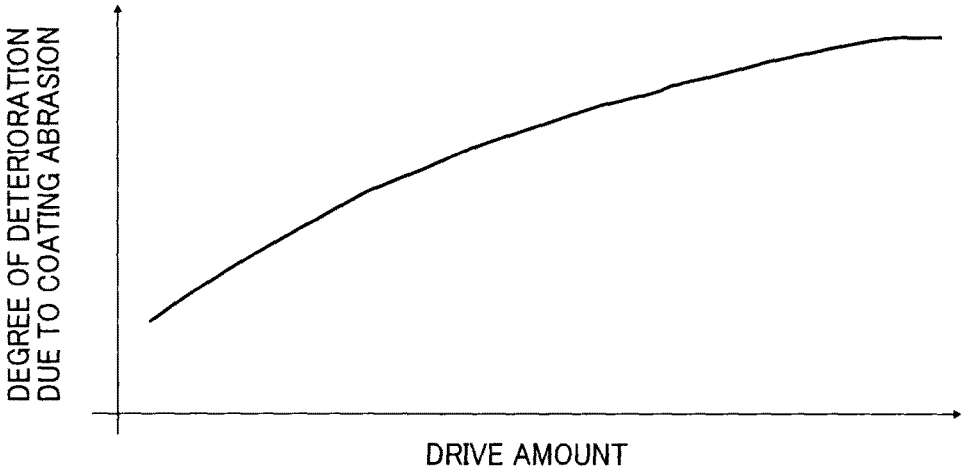
FIG. 5 is a graph illustrating a relation between progression degree of coating abrasion deterioration obtained by an experiment carried out by the inventors and drive number.

FIG. 5 is a graph illustrating a relation between progression degree of the coating abrasion deterioration obtained by an experiment carried out by the inventors and drive number. In the experiment, different from the image forming apparatus according to the embodiment, a tester for image forming apparatus to supply only the toner to the developing device is used. As illustrated in FIG. 5, a positive correlation is realized in the progression degree of the coating abrasion deterioration and the drive number. However, as compared with the component adhesion deterioration, the coating abrasion deterioration is affected by a change of a replacement amount of the magnetic carrier by supplying of the premix agent. For this reason, it has been determined by the experiment carried out by the inventors that the progression degree of the coating abrasion deterioration cannot be accurately predicted by the same algorithm as the component adhesion deterioration.

Therefore, the controller 100 of the image forming apparatus 1 according to the embodiment calculates a second index value showing the progression degree of the coating abrasion deterioration by a second expression different from the first expression. For the coating abrasion deterioration, the carrier supply amount is preferably considered. That is, for the second index value showing the progression degree of the coating abrasion deterioration, a numerical value thereof is preferably calculated by reflecting the carrier supply amount. As compared with when the average image area ratio is low, when the average image area ratio is high, a large amount of magnetic carrier is supplied and replacement of the magnetic carrier is promoted. For this reason, a value of the progression degree of the coating abrasion deterioration is ideally small. Therefore, the controller 100 calculates the second index value showing the coating abrasion deterioration degree by the following second expression.

Second index value=*f*(carrier supply amount,drive number) second expression

The carrier supply amount is calculated by the following expression.

Carrier supply amount=*f*(image area ratio,drive number)

The second index value shows the progression degree of the coating abrasion deterioration. In the second expression, an average stay travel distance correlating with the progression degree of the coating abrasion deterioration is calculated as the second index value. The average stay travel distance is a value obtained by converting an average stay time of the magnetic carrier in the developing device into a travel distance of the developing sleeve corresponding to the average stay time. The second index value is calculated using the second expression, so that the second index value can be calculated as an accurate value having considered the supply amount of the magnetic carrier.

The controller 100 calculates the first index value or the second index value described above, whenever a surface travel distance of the developing sleeve functioning as the drive number reaches 1 km.

Figure 6:
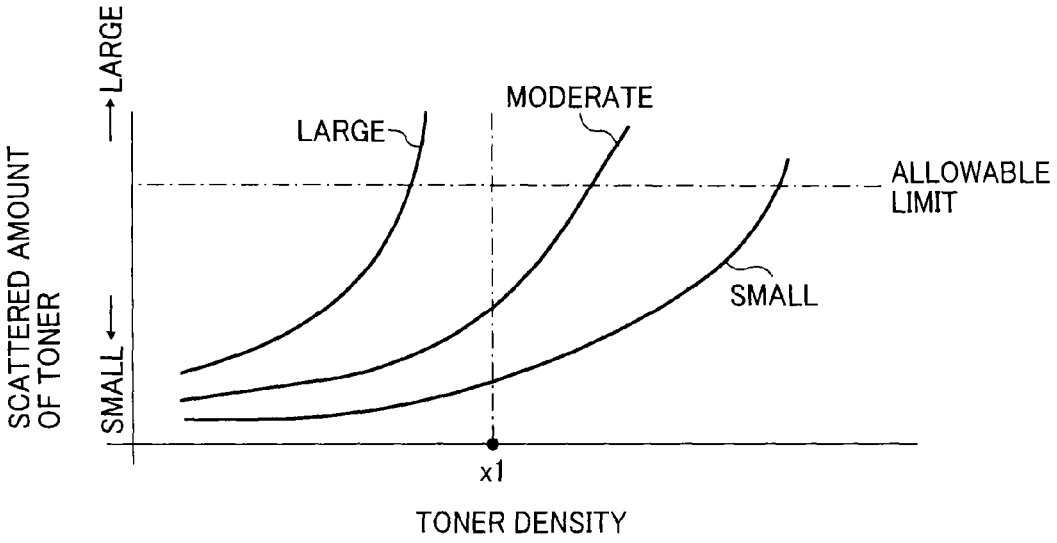
FIG. 6 is a graph illustrating a relation among scattered toner amount, toner density, and first index value.

FIG. 6 is a graph illustrating a relation among scattered toner amount, toner density, and first index value. As illustrated in FIG. 6, under a condition of the same toner density, if the first index value increases (the component adhesion deterioration of the magnetic carrier increases), the scattered toner amount increases. For example, when the toner density is set to x1 [wt %], as illustrated in FIG. 6, if the first index value is a large value, the scattered toner amount exceeds an allowable limit. However, if the first index value is an intermediate value or a small value, the scattered toner amount is maintained within the allowable limit. In order to maintain the same scattered toner amount, the toner density should be controlled to a small value, when the first index value increases.

Figure 7:
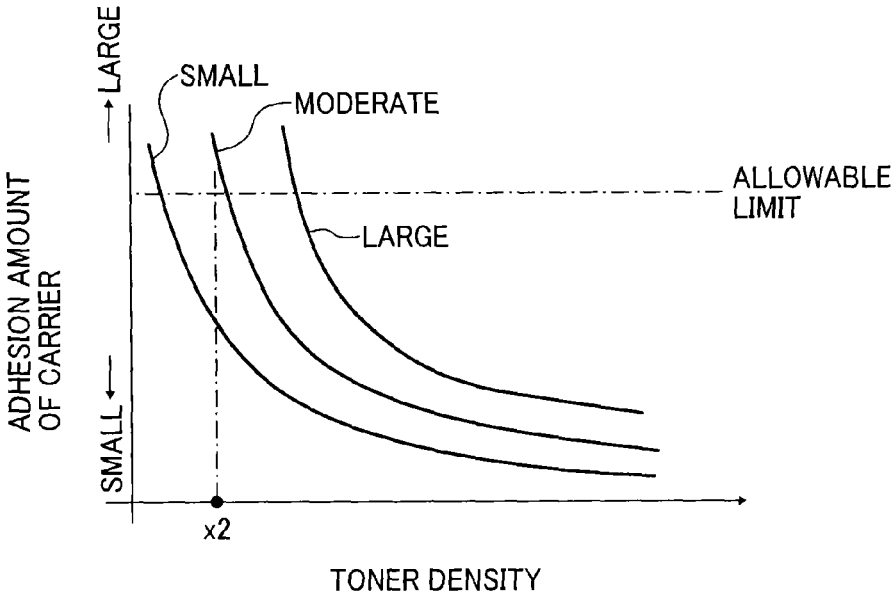
FIG. 7 is a graph illustrating a relation among carrier adhesion amount, toner density, and second index value.

FIG. 7 is a graph illustrating a relation among carrier adhesion amount, toner density, and second index value. As illustrated in FIG. 7, under a condition of the same toner density, if the second index value increases (the coating abrasion deterioration of the magnetic carrier progresses), the carrier adhesion amount increases. For example, in the case in which the toner density is set to x2 [wt %], as illustrated in FIG. 7, if the second index value is a large value, the carrier adhesion amount exceeds an allowable limit. However, if the second index value is an intermediate value or a small value, the carrier adhesion amount is maintained within the allowable limit. In order to maintain the same carrier adhesion amount, the toner density should be controlled to a large value, when the second index value increases.

Figure 8:
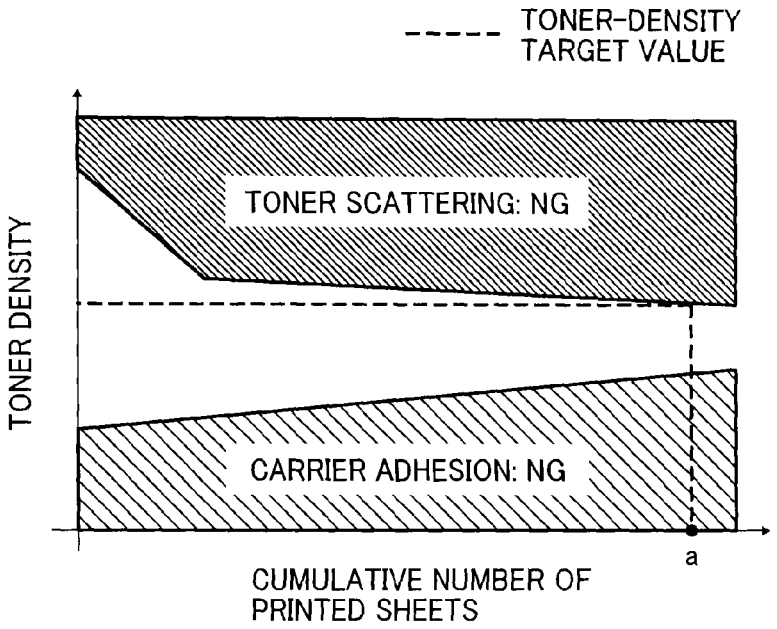
FIG. 8 is a graph illustrating an example of replacement timing of developer when a toner density is maintained at a constant value over a long period.

FIG. 8 is a graph illustrating an example of replacement timing of developer when a toner density is maintained at a constant value over a long period. When the toner density is maintained at the constant value over the long period, the scattered toner amount or the carrier adhesion amount presently exceeds an allowable amount under the condition of the toner density. When the component adhesion deterioration progresses earlier than the coating abrasion deterioration, the scattered toner amount exceeds the allowable amount earlier than the carrier adhesion amount. When the coating abrasion deterioration progresses earlier than the component adhesion deterioration, the carrier adhesion amount exceeds the allowable amount earlier than the scattered toner amount. In FIG. 8, an example of the case in which the component adhesion deterioration progresses earlier than the coating abrasion deterioration is illustrated and the scattered toner amount exceeds the allowable amount at a point of time when a cumulative number of printed pages reaches a [pages]. At this time, the carrier adhesion amount is much less than the allowable amount and even when the toner density is further decreased, the carrier adhesion amount can be maintained within the allowable amount.

The example of the case in which the component adhesion deterioration progresses earlier than the coating abrasion deterioration has been described. However, when the coating abrasion deterioration progresses earlier than the component adhesion deterioration, a result thereof is as follows. That is, the carrier adhesion amount exceeds the allowable amount at a point of time when a cumulative number of printed pages reaches a certain value. At this time, the scattered toner amount is much less than the allowable amount and even when the toner density is further increased, the scattered toner amount can be maintained within the allowable amount.

Therefore, if the controller 100 calculates the first index value to be the component adhesion deterioration degree and the second index value to be the coating abrasion deterioration degree, the controller 100 executes the following process, on the basis of the first index value and the second index value. That is, the controller 100 stores the same graph as the graph illustrated in FIG. 6 as a first algorithm. In addition, the controller 100 stores the same graph as the graph illustrated in FIG. 7 as a second algorithm. In addition, the controller 100 specifies, as an upper limit, a toner density to maintain the scattered toner amount at an allowable limit value under a condition of the first index value calculated in advance, using the first algorithm. In addition, the controller 100 specifies, as a lower limit, a toner density to maintain the carrier adhesion amount at an allowable limit value under a condition of the second index value calculated in advance, using the second algorithm. In addition, the controller 100 corrects a toner density target value with an intermediate value in a range from the upper limit to the lower limit. For example, when the upper limit is 9 [wt %] and the lower limit is 5 [wt %], the toner density target value is corrected with 7 [wt %].

Because a charged toner amount decreases in an environment of a high temperature and high humidity, toner scattering becomes easy to occur more. For this reason, the toner density (=upper limit) to maintain the scattered toner amount at the allowable limit value decreases according to the environment of the high temperature and high humidity. Because electric resistance of carrier particles decreases in the environment of the high temperature and high humidity, the carrier adhesion becomes easy to occur. For this reason, the toner density (=lower limit) to maintain the carrier adhesion amount at the allowable limit value increases according to the environment of the high temperature and high humidity. Therefore, in the image forming apparatus, an environment sensor to detect the temperature or the humidity in the apparatus is provided. As the first algorithm and the second algorithm, a plurality of algorithms corresponding to various environments are stored in the controller 100. The controller 100 is configured to select the first algorithm and the second algorithm corresponding to a detection result of the temperature and the humidity from the plurality of first algorithms and the plurality of second algorithms and calculate the upper limit and the lower limit.

Figure 9:
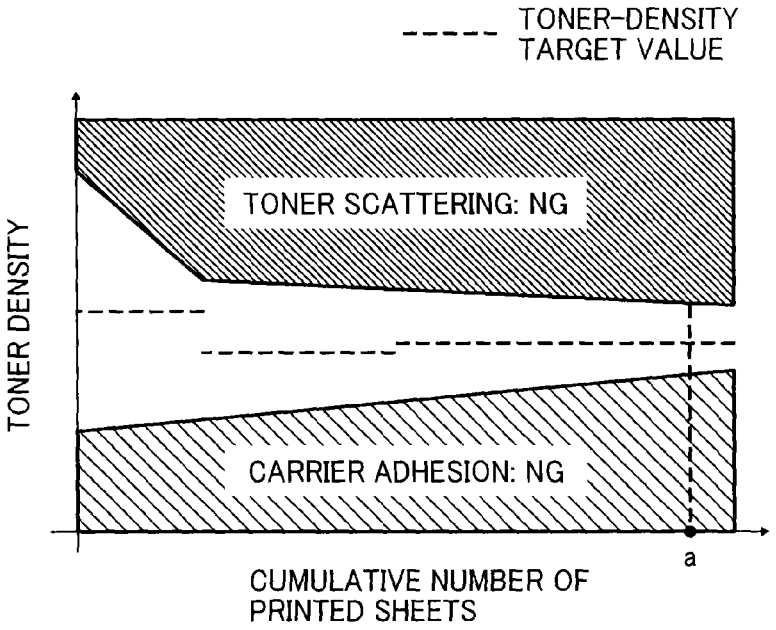
FIG. 9 is a graph illustrating extension of a replacement time of developer by correction of a toner density target value in the image forming apparatus.

As such, by correcting the toner density target value, as illustrated in FIG. 9, the toner density is changed to a value not causing the toner scattering or the carrier adhesion, the replacement time of the developer is appropriately extended, and cost saving is realized. In FIG. 9, an example of the case in which a state in which the toner scattering is caused is changed to a state in which the toner scattering is not caused, by correcting the toner density target value with a smaller value, is illustrated. In contrast, a state in which the carrier adhesion is caused can be changed to a state in which the carrier adhesion is not caused, by correcting the toner density target value with a larger value. When a difference of the upper limit and the lower limit is less than a predetermined threshold value, it is determined that the replacement time cannot be further extended and a message to urge the user to replace the developer is displayed.

If the toner density target value is corrected, a toner adhesion amount (image density) of an output image may be deviated from a target toner adhesion amount. That is, the image density may be greatly deviated from a target density.

However, the toner adhesion amount (image density) of the output image depends on a developing potential in addition to the toner density. Specifically, in the case of the same toner density, when the developing potential increases, the toner adhesion amount increases. For this reason, when the developing potential is corrected according to correction even though the toner density target value is corrected, a target image density can be maintained.

Figure 10:
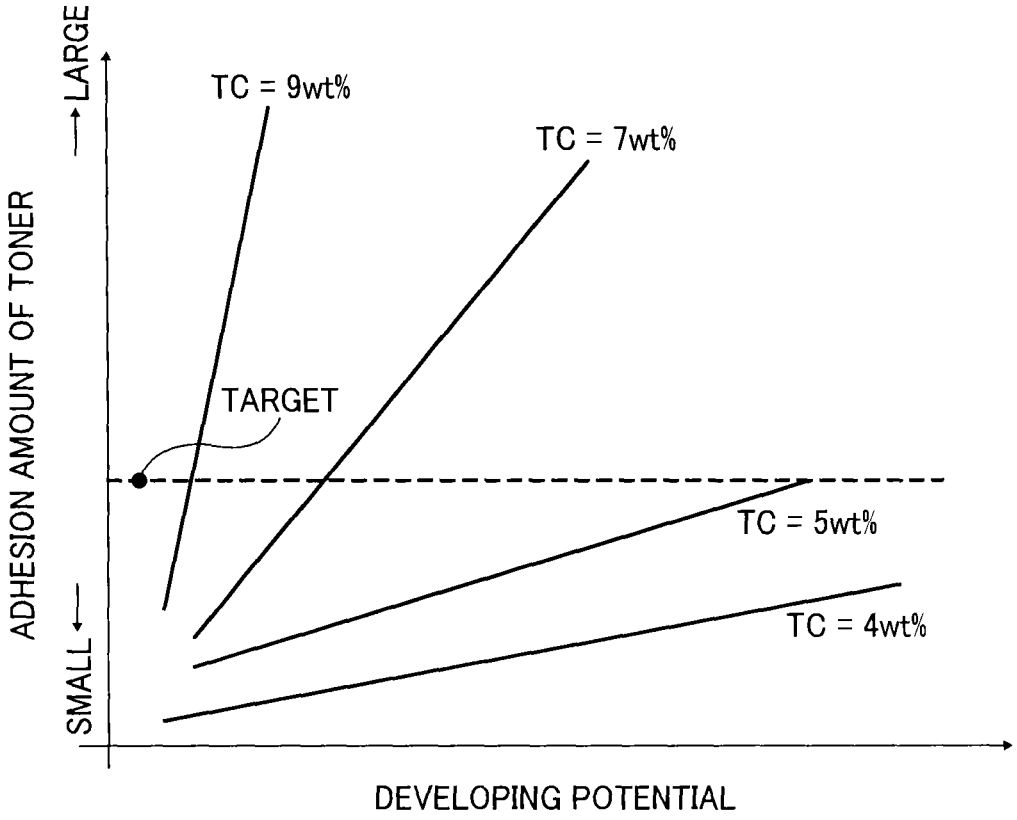
FIG. 10 is a graph illustrating a relation between toner adhesion amount of toner image, developing potential, and toner density.

Therefore, the controller 100 corrects parameters affecting the developing potential, such as a developing bias, a laser writing strength of an electrostatic latent image, and a photoconductor charging potential. Specifically, the controller 100 stores an algorithm showing a relation among the toner adhesion amount of the toner image, the developing potential, and the toner density, as illustrated in FIG. 10. For example, when the toner density target value is corrected with 7 [wt %] on the basis of the upper limit and the lower limit, the developing potential in which the target toner adhesion amount is obtained at the toner density of 7 [wt %] is specified on the basis of the algorithm described above. In addition, a parameter (hereinafter, referred to as a potential parameter) such as the developing bias is corrected such that the developing potential is obtained. As a result, the replacement time of the developer is appropriately extended by correction of the toner density target value and a stabilized image density can be realized over a long period while cost saving is realized.

Figure 11:
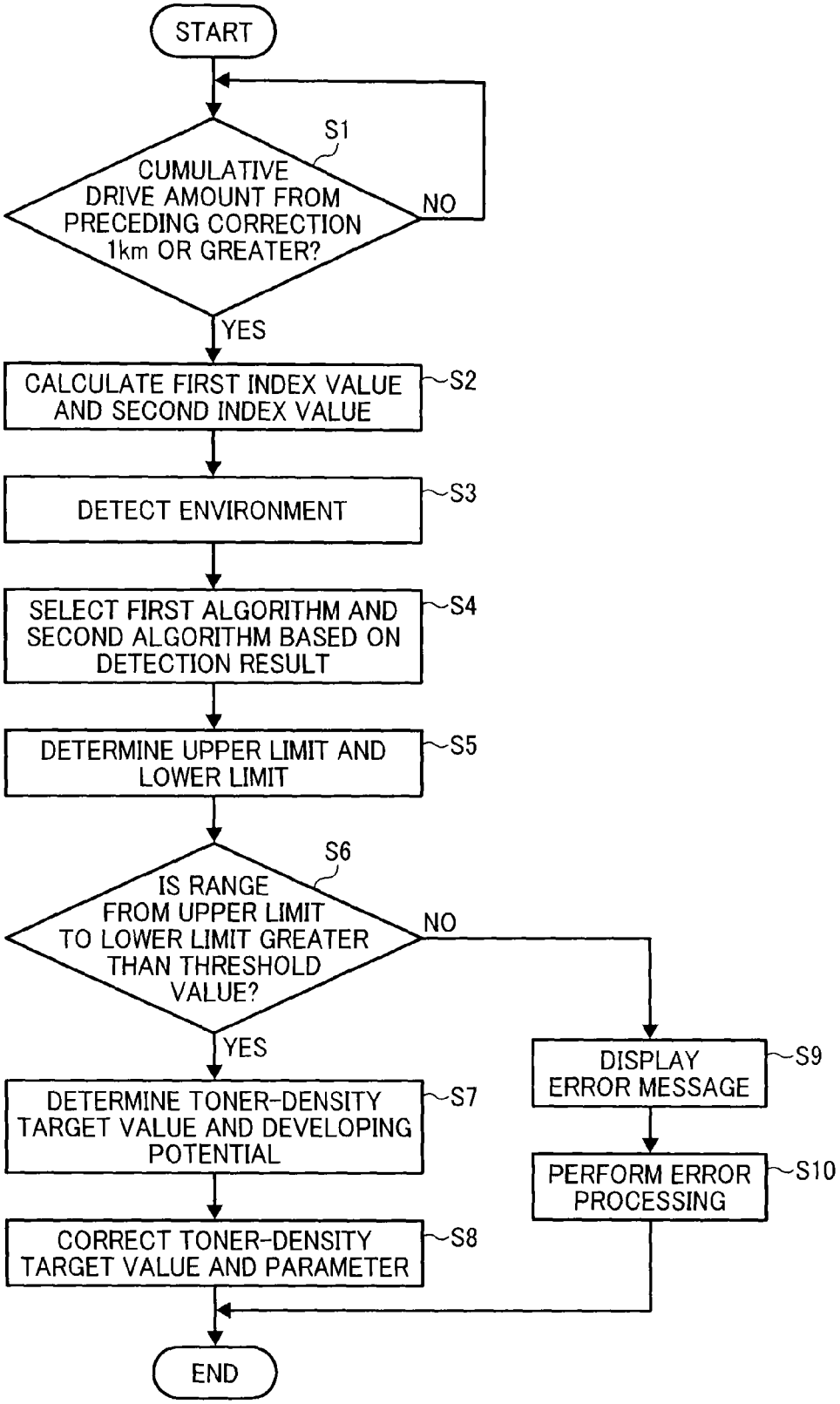
FIG. 11 is a flowchart illustrating a process flow of a target value correction process executed by the controller.

FIG. 11 is a flowchart illustrating a process flow of a target value correction process executed by the controller 100. The controller 100 executes the process flow for each color of T, Y, M, C, and K. The controller 100 having started the process flow maintains a standby state until the drive number (in this example, the surface travel distance of the developing sleeve) from a point of time when the toner density target value or the potential parameter has been corrected reaches 1 km (step 1: hereinafter, step is referred to as S). When the drive number reaches 1 km (Y in S1), the controller 100 calculates the first index value and the second index value (S2) and obtains the detection result of the temperature and the humidity by the environment sensor (S3). Next, the controller 100 selects the first algorithm and the second algorithm corresponding to the detection result of the temperature and the humidity (S4) and determines the upper limit and the lower limit of the toner density, on the basis of the algorithms, the first index value, and the second index value (S5). The controller 100 determines whether a range of the upper limit and the lower limit exceeds a threshold value to determine whether the developer reaches the life end (S6). When the range reaches the threshold value (Y in S6), that is, the range from the upper limit to the lower limit is relatively wide, the controller 100 determines that the developer does not yet reach the life end and corrects the toner density target value and the potential parameter. Specifically, the controller 100 determines the toner density target value on the basis of the upper limit and the lower limit and specifies the developing potential in which the target toner adhesion amount is obtained at the same toner density as the toner density target value (S7). Then, the controller 100 corrects the toner density target value and the potential parameter with the determined values (S8). Meanwhile, when the range of the upper limit and the lower limit does not exceed the threshold value (N in S6), the controller 100 displays a message to urge the user to replace the developer (S7) and executes an error process (S10). By the error processing, the controller 100 displays the message continuously until the developer is replaced.

The content described above is exemplary and the present disclosure achieves a particular effect for each of the following aspects.

[Aspect A]

In aspect A, an image forming apparatus includes a latent image bearer (for example, a photoconductor 5), a developing device (for example, a developing device 8) to develop a latent image on the latent image bearer using a developer including a toner and a carrier, a toner density sensor (for example, a toner density sensor 80) to detect a toner density of the developer in the developing device, a supplier (for example, a toner supplier 4) to supply the toner to the developing device, and a controller (for example, a controller 100) to control the supplier according to a detection result of the toner density by the toner density sensor and a toner density target value to adjust the toner density of the developer in the developing device. The controller is configured to correct the toner density target value and an imaging condition affecting a toner adhesion amount of an output image separately from the toner density, according to a component adhesion deterioration degree being a deterioration degree of the carrier due to adhesion of a toner component, obtained based on at least an average image area ratio of the output image, and a coating abrasion deterioration degree being a progression degree of deterioration due to coating abrasion of the carrier, obtained based on at least the average image area ratio of the output image.

In such a configuration, when toner scattering might occur according to the progression of the component adhesion deterioration of the carrier or when the carrier adhesion might occur according to the progression of the coating abrasion deterioration of the carrier, the controller corrects the toner density target value as follows. That is, a value to maintain both the toner scattering and the carrier adhesion in allowable ranges is calculated as the toner density according to a balance of a component adhesion deterioration degree and a coating abrasion deterioration degree and the toner density target value is corrected with the same value as the value. If the toner density of the developer is changed by correction, an image density (toner adhesion amount of an image) may be deviated from the target value due to a variation in imaging performance according to a change in the toner density. Therefore, an imaging condition affecting the toner adhesion amount of the output image separately from the toner density, such as a developing bias, is corrected according to a correction amount of the toner density target value. This series of corrections can be repetitively performed until next timing arrives. That is, the next timing is timing when the component adhesion deterioration and the coating abrasion deterioration progress in balance in which any one of the toner scattering and the carrier adhesion cannot be maintained in the allowable range, even though the toner density of the developer is increased or decreased by correction of the toner density target value. As a result, a replacement time of the developer can be extended to appropriate timing according to the balance of the component adhesion deterioration and the coating abrasion deterioration of the carrier and cost saving can be realized.

[Aspect B]

In aspect B, the controller of the image forming apparatus according to aspect A is configured to obtain the component adhesion deterioration degree based on at least the average image area ratio of the output image and a cumulative drive amount of the developing device, determine an upper limit of the toner density based on the component adhesion deterioration degree, determine the coating abrasion deterioration degree based on at least the average image area ratio and the cumulative drive amount, determine a lower limit of the toner density based on the coating abrasion deterioration degree, correct the toner density target value to a corrected toner density target value between the upper limit and the lower limit, and correct the imaging condition according to the corrected toner density target value. In such a configuration, the toner density target value is corrected to the corrected toner density target value between the upper limit based on the component adhesion deterioration degree and the lower limit based on the coating abrasion deterioration degree, so that the toner scattering due to the component adhesion deterioration and the carrier adhesion due to the coating abrasion deterioration can be maintained in the allowable ranges, respectively. The imaging condition is corrected according to the correction amount of the toner density target value, thus preventing the image density from being varied due to correction of the toner density target value.

[Aspect C]

In aspect C, the controller of the image forming apparatus according to aspect B is configured to correct a parameter affecting a developing potential as the imaging condition. In such a configuration, the developing potential is changed by correction of the parameter, thus preventing the image density from being varied due to correction of the toner density target value.

[Aspect D]

In aspect D, the controller of the image forming apparatus according to aspect C is configured to correct the parameter according to the toner density target value and a predetermined target toner adhesion amount stored previously for the output image. In such a configuration, a parameter condition that can offset a variation of the toner adhesion amount of the output image due to correction of the toner density target value can be determined with high precision, based on the toner density target value and the target toner adhesion amount.

[Aspect E]

In aspect E, the supplier of the image forming apparatus according to any one of aspects B to D contains a premix agent including a mixture of the toner and the carrier. In such a configuration, the toner and the carrier are supplied to the developing device, a life end time of the developer is delayed, and ease of maintenance can be enhanced.

[Aspect F]

In aspect F, the controller of the image forming apparatus according to aspect E is configured to obtain the component adhesion deterioration degree and the coating abrasion deterioration degree based on the average image area ratio, the cumulative drive amount, and a supply amount of the premix agent. In such a configuration, the component adhesion deterioration degree and the coating abrasion deterioration degree of the carrier can be accurately obtained in a structure in which the premix agent is used.

[Aspect G]

In aspect G, the controller of the image forming apparatus according to aspect F is configured to calculate the supply amount based on the average image area ratio and one of the cumulative drive amount and a predetermined target toner adhesion amount stored previously for the output image. In such a configuration, a supply amount is calculated by an arithmetic method without being actually measured and cost saving can be realized.

[Aspect H]

In aspect H, the image forming apparatus according to any one of aspects B to G further includes a memory to store a first algorithm of relations among the component adhesion deterioration degree, the toner density of the developer, and a scattered toner amount and a second algorithm of relations among the coating abrasion deterioration degree, the toner density of the developer, and a carrier adhesion amount. The controller is configured to determine the upper limit based on the component adhesion deterioration degree and the first algorithm and determine the lower limit based on the coating abrasion deterioration degree and the second algorithm. In such a configuration, the marginal toner density not causing the toner scattering can be accurately calculated as the upper limit, based on the component adhesion deterioration and the first algorithm. In addition, the marginal toner density not causing the carrier adhesion can be accurately calculated as the lower limit, based on the coating abrasion deterioration degree and the second algorithm.

In the above-described embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a latent image bearer;

a developing device configured to develop a latent image on the latent image bearer using a developer including a toner and a carrier;

a toner density sensor configured to detect a toner density of the developer in the developing device;

a supplier configured to supply the toner to the developing device; and a controller configured to control the supplier according to a detection result of the toner density by the toner density sensor and a toner density target value to adjust the toner density of the developer in the developing device, calculate a component adhesion deterioration degree that is a deterioration degree of the carrier due to adhesion of a toner component, obtained based on at least an average image area ratio of the output image, wherein the component adhesion deterioration degree increases as the average image area ratio increases, and calculate a coating abrasion deterioration degree that is a progression degree of deterioration due to coating abrasion of the carrier, obtained based on at least the average image area ratio of the output image, wherein the coating abrasion deterioration degree increases as the average image area ratio decreases, and correct the toner density target value and imaging condition affecting a toner adhesion amount of an output image separately from correcting the toner density, and based on the calculated component adhesion deterioration degree and the calculated coating abrasion deterioration degree.

2. The image forming apparatus according to claim 1, wherein the controller is configured to obtain the component adhesion deterioration degree based on at least the average image area ratio of the output image and a cumulative drive amount of the developing device, determine an upper limit of the toner density based on the component adhesion deterioration degree, determine the coating abrasion deterioration degree based on at least the average image area ratio and the cumulative drive amount, determine a lower limit of the toner density based on the coating abrasion deterioration degree, correct the toner density target value to a corrected toner density target value between the upper limit and the lower limit, and correct the imaging condition according to the corrected toner density target value.

3. The image forming apparatus according to claim 2, wherein the controller is configured to correct a parameter affecting a developing potential as the imaging condition.

4. The image forming apparatus according to claim 3, wherein the controller is configured to correct the parameter according to the toner density target value and a predetermined target toner adhesion amount stored previously for the output image.

5. The image forming apparatus according to claim 2, wherein the supplier contains a premix agent including a mixture of the toner and the carrier.

6. The image forming apparatus according to claim 5, wherein the controller is configured to obtain the component adhesion deterioration degree and the coating abrasion deterioration degree based on the average image area ratio, the cumulative drive amount, and a supply amount of the premix agent.

7. The image forming apparatus according to claim 6, wherein the controller is configured to calculate the supply amount based on the average image area ratio and one of the cumulative drive amount and a predetermined target toner adhesion amount stored previously for the output image.

8. The image forming apparatus according to claim 2, further comprising a memory configured to store a first algorithm of relations among the component adhesion deterioration degree, the toner density of the developer, and a scattered toner amount and a second algorithm of relations among the coating abrasion deterioration degree, the toner density of the developer, and a carrier adhesion amount, wherein the controller is configured to determine the upper limit based on the component adhesion deterioration degree and the first algorithm and determine the lower limit based on the coating abrasion deterioration degree and the second algorithm.

9. The image forming apparatus according to claim 3, wherein the parameter is a drive number being a cumulative chive amount of the developing device.

10. The image forming apparatus according to claim 9, wherein the drive number further includes a surface travel distance of a developing sleeve bearing the developer and rotating in the developing device, a drive time of the developing device, and a cumulative number of printed pages.

11. The image forming apparatus according to claim wherein the controller is further configured to:

determine an upper limit of the toner density based on the component adhesion deterioration degree, determine a lower limit of the toner density based on the coating abrasion deterioration degree, extend a replacement time of the developer in response to the corrected toner density target value being in an allowable range, the allowable range being a range between the upper limit of the toner density and the lower limit of the toner density, trigger the replacement time of the developer when a difference between the upper limit of the toner density and the lower limit of the toner density is less than a predetermined threshold value, and output a replace developer message at the determined replacement time.

* * * * *